United States Patent [19]

Morris

[11] 4,024,653

[45] May 24, 1977

[54] BUMPER BLADE WITH TIE-DOWN ATTACHMENT

[75] Inventor: Caleb Ganeo Morris, Overland Park, Kans.

[73] Assignee: Caleb G. Morris, Overland Park, Kans.

[22] Filed: Mar. 23, 1976

[21] Appl. No.: 659,328

[52] U.S. Cl. ..... 37/42 R; 37/50

[51] Int. Cl.[2] ..... E01H 5/04

[58] Field of Search ..... 37/50, 41, 42 R, 42 VL

[56] References Cited

UNITED STATES PATENTS

| | | | |
|---|---|---|---|
| 3,477,149 | 11/1969 | Wagner | 37/50 |
| 3,608,216 | 9/1971 | Prescott | 37/42 R |
| 3,807,065 | 4/1974 | Billingsley | 37/50 |
| 3,828,449 | 8/1974 | Miceli | 37/41 |
| 3,883,965 | 5/1975 | Poirer, Sr. et al. | 37/42 R |

FOREIGN PATENTS OR APPLICATIONS

| | | | |
|---|---|---|---|
| 1,305,378 | 1/1973 | United Kingdom | 37/41 |

OTHER PUBLICATIONS

"Clear Your Drive the Easy Way," Popular Mechanics Dec. 1971, pp. 166 and 190.

*Primary Examiner*—E. H. Eickholt

[57] ABSTRACT

Two tubular spaced apart upstanding U-shaped skids each having an upper and lower end are detachably mounted to a conventional vehicle snow plow blade. A protective bumper pad is positioned on each skid at the juncture of the two ends. A rubber tie-down strap having hooks at each end for engaging the vehicle's bumper is wrapped around each pad thereby attaching the blade to the bumper in a secure but independent suspension.

1 Claim, 6 Drawing Figures

FIG. 1
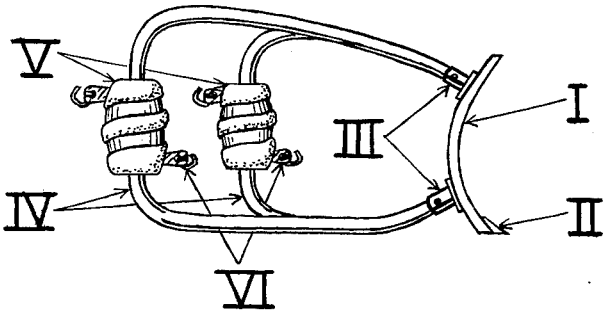
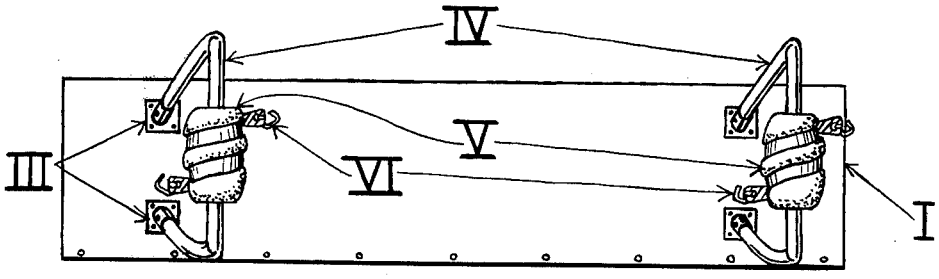
FIG. 2
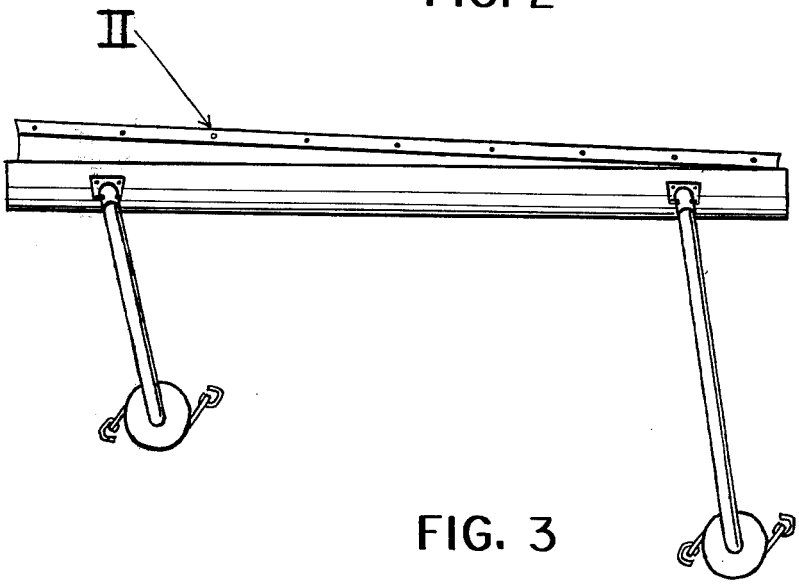
FIG. 3

BUMPER BLADE WITH TIE-DOWN ATTACHMENT

The device is directed to an improvement in mounting snow plows on vehicle bumpers. The improved mounting system allows the snow plow to be readily assembled, mounted to the vehicle's bumper for use and easily disassembled to facilitate storage when not in use.

It is an object of the invention to provide a lightweight and inexpensive automobile powered snow plow attached to the automobile's bumper.

It is a further object of the invention to provide a snow blade mounting system which protects an automobile bumper from scratching or denting.

It is a further object of the invention to provide a snow plow mounting system which can be readily assembled, mounted for use on the vehicle's bumper and dissassembled for ease of storage.

The above objects of the invention are achieved by attaching novel U-shaped tubular metal skids to a snow plow blade. The vertical portion of each skid is snugly encased by a bumper pad. Flexible rubber tie-down straps are wrapped around each bumper pad. Hooks on the end of each tie-down strap are used to secure the snow plow to the bumper.

These and other objects and advantages of the invention are set forth in the following description made in connection with the accompanying drawings in which like reference characters refer to similar parts throughout the several views and in which:

FIG. 1 is a side view of the invention;

FIG. 2 is a rear view;

FIG. 3 is a top view;

DESCRIPTION OF THE PREFERRED EMBODIMENT

Figure 4:
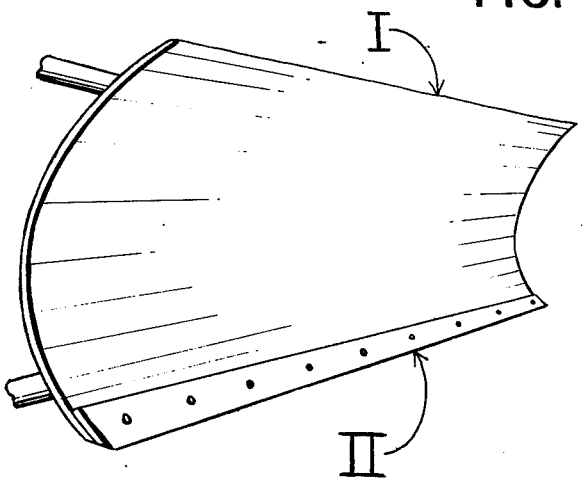
FIG. 4 is a detail view of the blade.

Referring to the drawings, the device is constructed of aluminum material for the blade I and U-shaped support skids IV. The device also consists of a cushion or bumper pad V on each skid IV to protect an automobile bumper (not shown) from scratching or denting.

Elastic rubber tie-downs VI are wrapped around each bumper pad V. Steel hooks are secured to each end of the tie-down straps. These hooks are used to secure the skids to the vehicle's bumper. The rubber tie-down fix the blade I to the bumper to form a secure but independent suspension. The skids IV are made of tubular aluminum. The skids align the blade with the surface allowing the car to push the snow plow forward.

Figure 5:
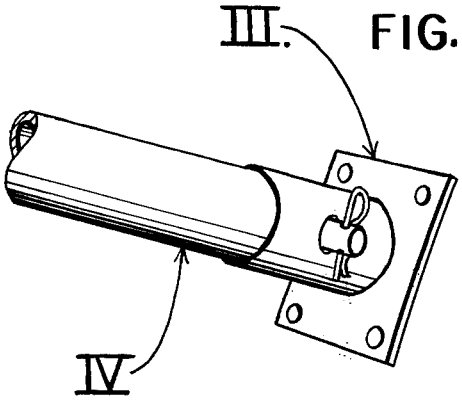
FIG. 5 is a detail view of the skid fastening means.
Figure 6:
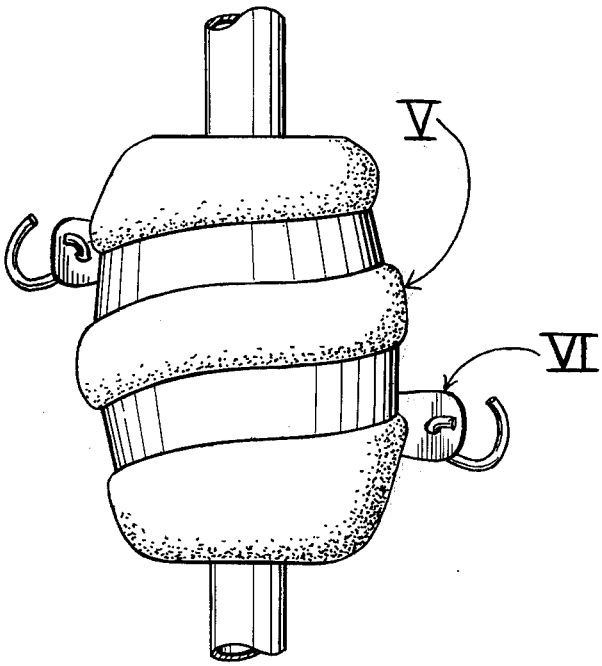
FIG. 6 is a detail view of the bumper pad and rubber tie-down strap.

To use the device, the upper and lower ends of the U-shaped skids IV are inserted into skid mounts III positioned on the back of the blade I and locked in place by a lock-pin as best shown in FIG. 5.

The snow plow is then placed in front of the vehicle with its concave surface forward. The bumper pads V are then slid along the vertical portion of each skid so as to align with the bumper. Each tie-down strap is hooked underneath the bumper and across the bumper pad and also hooked to the top of the bumper. Following this, the straps should be checked for tightness and security to the bumper. After attachment the vehicle should be slowly driven forward to remove snow. A conventional blade edge II shown in FIG. 4 may be attached to the front of the curved blade I.

The device will enable homeowners to clear their driveways of snow as long as they are able to drive a car, regardless of age or physical handicaps.

Use of elastic tie-down straps provides a semi-independent rather than a rigid attachment to the bumper. Basically, the device is limited only to lightweight home snow removal applications. The aluminum construction of the blade and skids limits weight without sacrificing strength, corrosion resistance and ease of use and storage.

I claim:

1. In combination with a vehicle having a bumper, a snow plow blade, a pair of tubular spaced apart upstanding U-shaped skid means, said skid means each having an upper and lower end detachably mounted to the rear of said blade, a protective bumper means slideable positioned on each skid means so as to be aligned with the height of said bumper, and rubber tie-down strap means having hook means for engaging said bumper, said tie-down strap means being wrapped around each of said bumper pad means whereby the snow plow blade is attached to said bumper to form a secure but independent suspension.

* * * * *